United States Patent [19]

Fowler

[11] Patent Number: 4,653,398

[45] Date of Patent: Mar. 31, 1987

[54] ALUMINUM CAN COMPACTOR AND METHOD

[75] Inventor: Stanley Fowler, Fullerton, Calif.

[73] Assignee: Fowler Enterprises, Inc., La Habra, Calif.

[21] Appl. No.: 756,815

[22] Filed: Jul. 18, 1985

Related U.S. Application Data

[63] Continuation-in-part of Ser. No. 588,128, Mar. 9, 1984, abandoned.

[51] Int. Cl.[4] ..... B30B 9/32

[52] U.S. Cl. ..... 100/233; 100/293; 100/295; 100/902

[58] Field of Search ..... 100/902, 292, 293, 295, 100/233, 234, 235, 116; 99/581, 582, 583

[56] References Cited

U.S. PATENT DOCUMENTS

| | | | |
|---|---|---|---|
| 147,317 | 2/1874 | Fields . | |
| D. 247,294 | 2/1978 | Grable . | |
| 2,037,553 | 4/1936 | Wagner | 100/234 X |
| 2,466,907 | 4/1949 | Nadolny . | |
| 2,603,270 | 7/1952 | Voigt . | |
| 3,036,517 | 5/1962 | Malarsky | 100/233 |
| 3,667,386 | 6/1972 | Workman . | |
| 3,766,849 | 10/1973 | Maron . | |
| 3,832,941 | 9/1974 | Moller | 100/902 X |
| 3,921,256 | 11/1975 | Huebotter . | |
| 3,980,015 | 9/1976 | Woodard | 100/902 X |
| 3,988,978 | 11/1976 | Flick | 100/902 X |
| 4,291,618 | 9/1981 | Heiser . | |
| 4,333,397 | 6/1982 | Modes . | |
| 4,383,480 | 5/1983 | Jerden . | |
| 4,393,765 | 7/1983 | Accettura . | |
| 4,403,545 | 9/1983 | Toburen | 100/293 X |
| 4,498,385 | 2/1985 | Manley | 100/902 X |

*Primary Examiner*—Billy J. Wilhite

*Attorney, Agent, or Firm*—Gausewitz, Carr & Rothenberg

[57] ABSTRACT

A can compactor in which there is relative movement between a cam and a can, in a direction generally tangential to the can. Such relative movement progressively collapses the can sides, following which the can ends are bent over further than they were bent as the result of the can-side collapsing.

14 Claims, 16 Drawing Figures

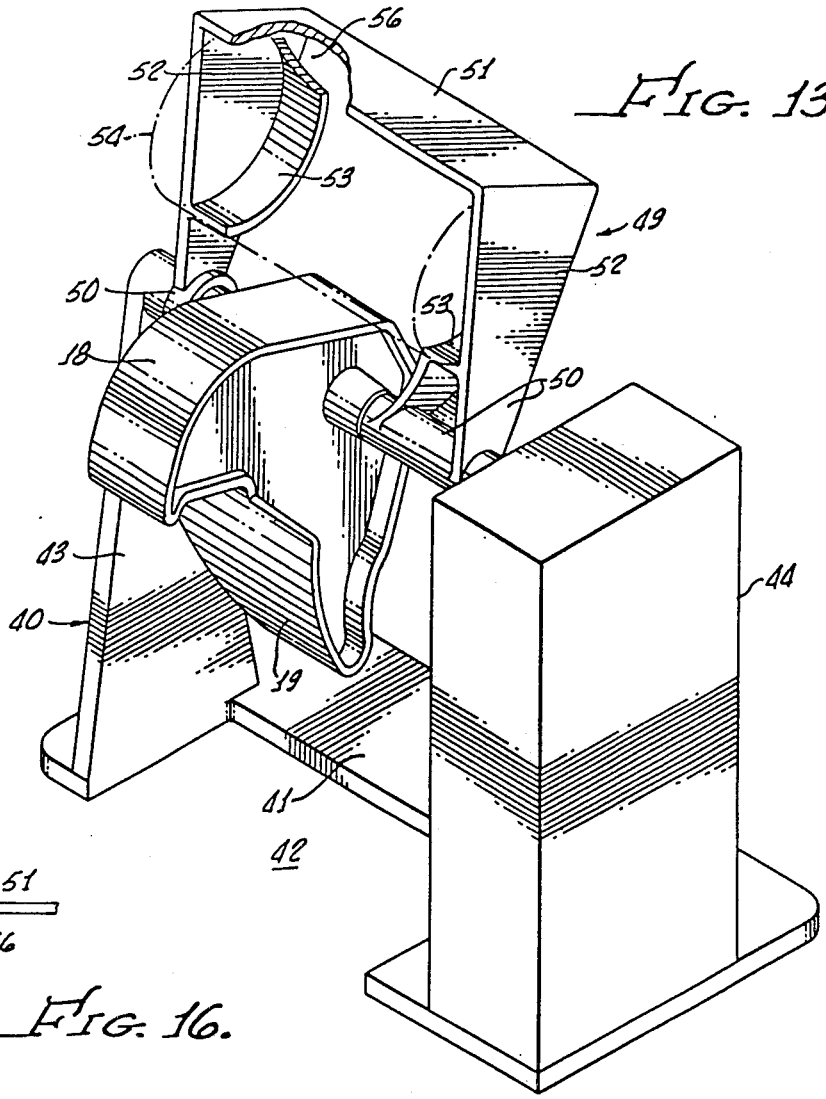
FIG. 13.
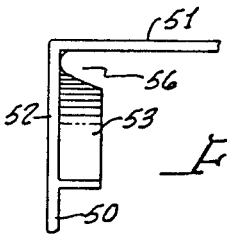
FIG. 16.
FIG. 14.
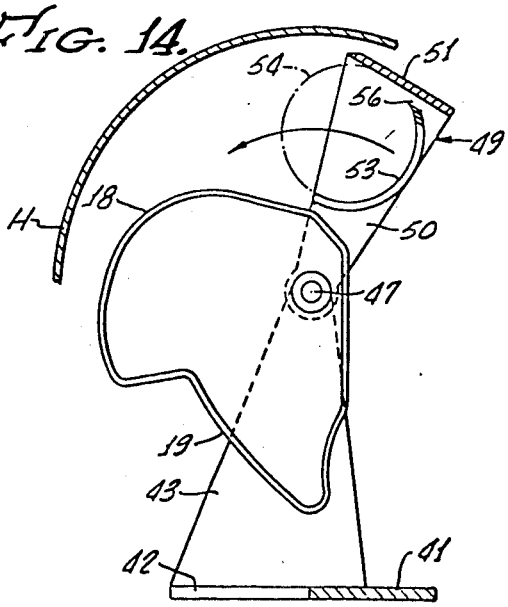
FIG. 15.
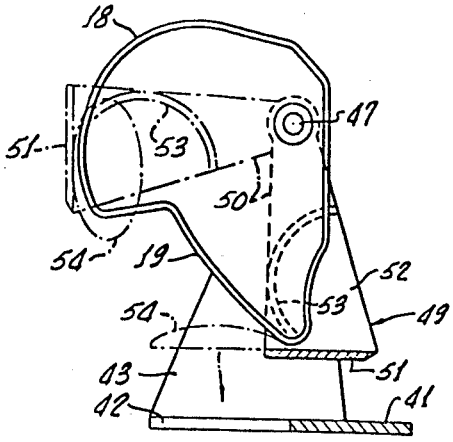

ALUMINUM CAN COMPACTOR AND METHOD

CROSS-REFERENCE TO RELATED APPLICATION

This is a continuation-in-part of patent application Ser. No. 588,128, filed Mar. 9, 1984, for Aluminum Can Compactor and Method, now abandoned.

BACKGROUND OF THE INVENTION

There are, essentially, two kinds of can commpactors (or crushers) for home use. One type effects endwise crushing of the can and creates what is known as a "hockey puck". The other type compacts the can laterally, forming what is sometimes termed a "bulls-eye" configuration. The hockey-puck type has various disadvantages, including: (1) large force is required for the compaction, (2) the compaction frequently results in rupturing of the can, which creates sharp edges that can cut the fingers of users and processors unless gloves are worn (the sharp edges also produce the disadvantage of cutting and "grabbing" plastic refuse bags), (3) recycling by the processors is difficult, because the hockey-puck shape and density are such that the shredding incident to recycling is difficult to accomplish, (4) the hockey-puck shape is not adapted to be fed into the "reverse vending machines" in supermarkets, (5) hockey pucks make excellent flying missiles in school yards where can compactors are employed.

The bulls-eye configuration produces marked advantages and few, if any, disadvantages. The advantages include: (1) there is seldom, if ever, a rupturing of the cans and consequent creation of sharp edges, (2) the cans are easily handled by the shredding machines used in reprocessing plants, (3) the bulls-eye compacted cans may be fed into many reverse-vending machines in supermarkets, (4) the bulls-eye cans do not "throw" well at schools.

Various attempts have been made to create satisfactory apparatus for compacting cans into the bulls-eye configuration, but such attempts have been deficient. The defects of presently-known compactors for creating bulls-eye shapes are numerous, and include one or more of the following: (1) necessity for more than one stroke or hit, (2) complexity and/or requirement for excessive force, (3) necessity of using two hands throughout the compacting operation, (4) inability to achieve the desired shape with a single stroke that needs only one hand of the operator, (5) danger that children will be inadvertently injured when playing with the apparatus, (6) absence of a neat, clean appearance.

SUMMARY OF THE INVENTION

The present apparatus and method will compact a can into the bulls-eye configuration in only a few seconds, requiring only one hand of the operator. This despite the fact that the present apparatus has only a single moving part.

The result bulls-eye can is shaped properly (and has the correct density) for shredding during recycling, is not ruptured, and may be fed into some reversv-ending machines in supermarkets. The apparatus does not involve maintenance or wear problems, there being substantially nothing to wear relative to the single moving part. The apparatus is neat and "clean" in appearance, fun to use, and workable with relatively low force. The can is held automatically as soon as placed in its seat, and unloading occurs automatically as soon as the operating element is lifted, so that the can may drop into a receptacle disposed therebeneath.

The single moving part has a cam portion that flattens the center of the can during rotation of an operating crank through a predetermined angle. It also has an end-compression portion that automatically engages and compacts the can end regions as soon as the cam portion has performed its function. The cam creates a "tucking" action, but this tucking action does not cause the can to grip the cam portion because means are provided to prevent the can from following the cam portion. Thus, by merely lifting the operating element, the can will drop as indicated above.

In one of the illustrated embodiments, the compacting of the can end regions is effected by compression followed by reverse-directed movement so as to release the can. In a second illustrated embodiment, movement continues in the same direction before, during and after can compaction.

BRIEF DESCRIPTION OF THE DRAWINGS

FIG. 13 is an isometric view of a second embodiment of the invention, in which the can-holding means is driven past a first and then a second element;

FIG. 14 is a vertical sectional view of the embodiment shown in FIG. 13;

FIG. 15 corresponds to FIGS. 13 and 14 but shows the can-holding means in two different positions during the can-compacting operation; and FIG. 16 is a view looking toward the right from the upper-left part of FIG. 13, and showing one of the opening regions of the can-holding means.

DETAILED DESCRIPTION OF THE PREFERRED EMBODIMENTS

Figure 1:
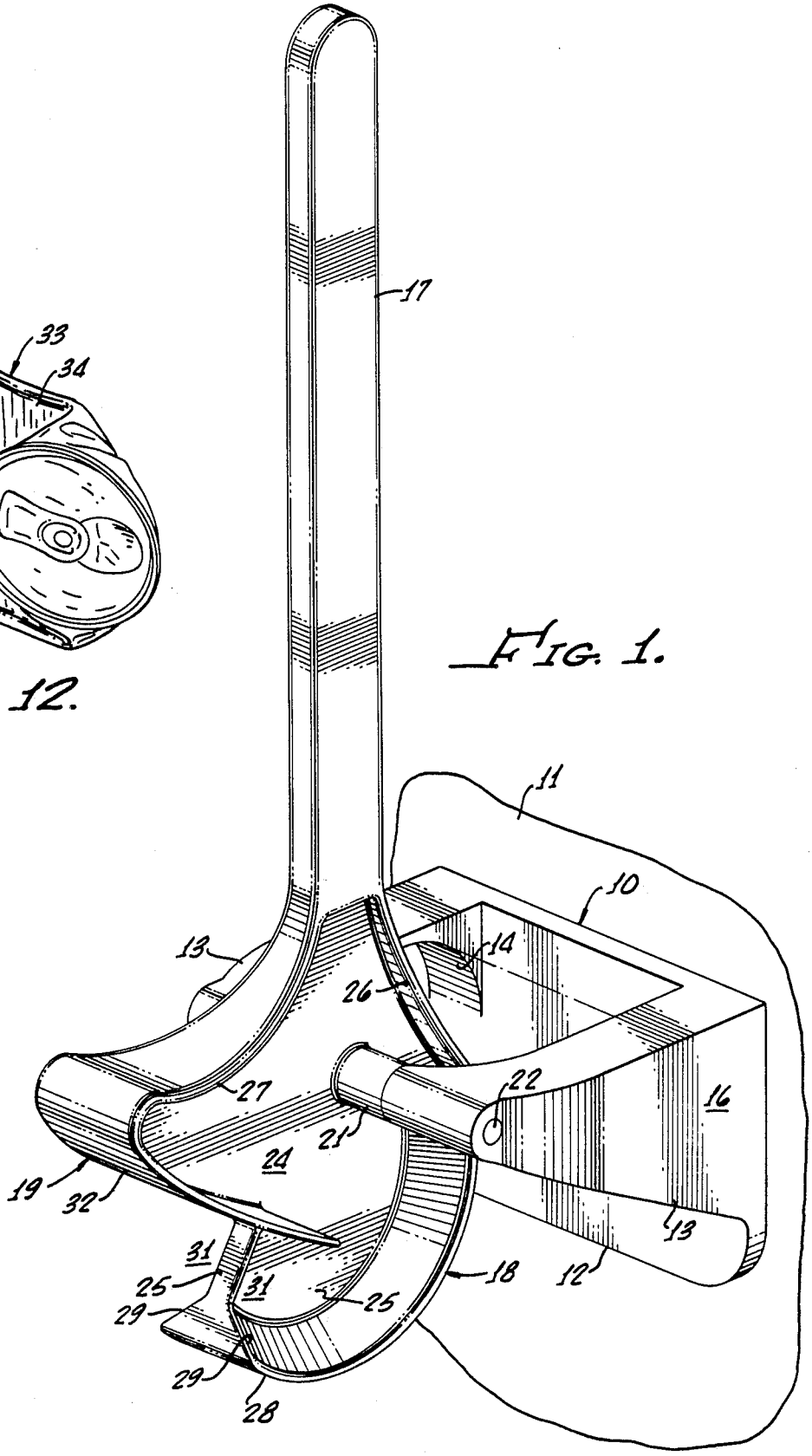
FIG. 1 is an isometric view of the can compactor, showing it as mounted on a wall.

Referring to FIG. 1, the apparatus comprises a generally U-shaped bracket 10 adapted to be supported on any suitable surface, such as a stand or the wall indicated at 11. Bracket 10 functions as a seat for the can to be compacted, and also functions as the pivot support for the single moving part of the apparatus.

Stated more definitely, the bracket has a bottom or web portion 12 suitably secured to wall 11 and from which two side portions 13 extend. The underside of side portions 13 define generally semicylindrical seats 14 for the end portions of the can, reference being made to FIGS. 1, 2 and 7. The side portions 13 have continuous outer walls 16 which perform the function of preventing excessive endwise movement of the can when seated on seats 14, as well as enhancing the appearance of the apparatus.

The seats 14 are so located that, when a can is seated therein, it is adjacent or tangential to web 12.

Figure 3:
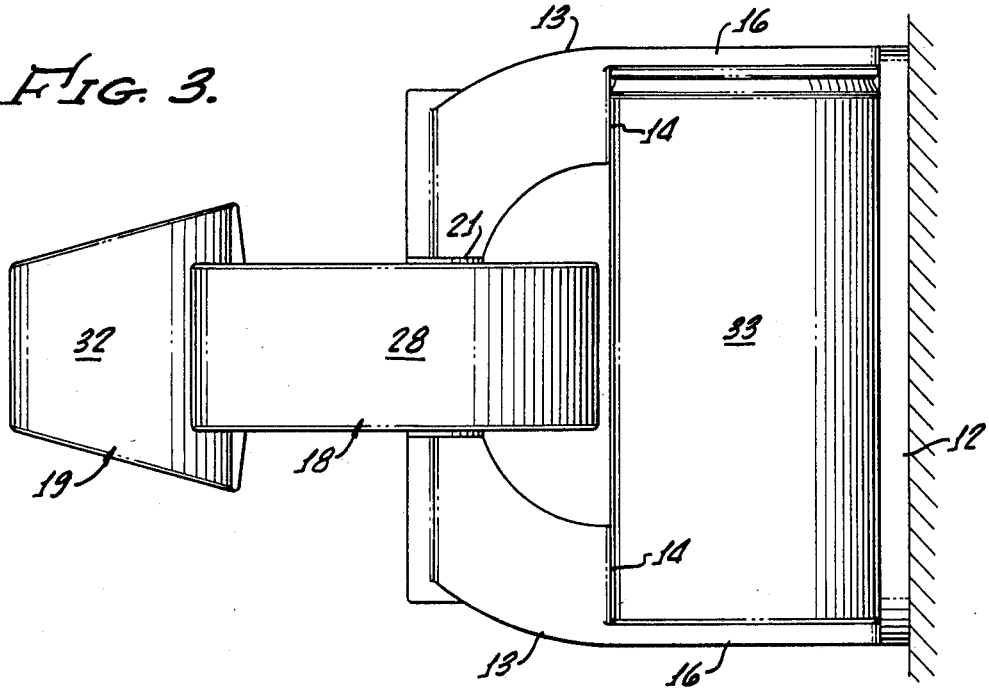
FIG. 3 is a bottom plan view of the showing of FIG. 2.

The moving part comprises an elongated handle or crank 17 connected to a can-side compression portion 18 and can-end compression portion 19. A hub portion 21 is formed integrally with the region of the moving part adjacent the upper end (when handle 17 extends upwardly as shown in FIG. 1) of side compression portion 18. Portion 21 receives a pin 22 that extends, parallel to the seated can, to the outer ends of side portions 13 of the bracket 10. Such outer ends of sides 13 curve inwardly, as shown (for example) in FIG. 3, so as to come into close abutment with the ends of the hub 21. In this way, the moving part is centered so as to always remain midway between sides 13.

The illustrated and preferred moving part is cast integrally, of aluminum or other metal.

The operating portion of the moving part is recessed at 24, as illustrated, on both sides, it being understood that the moving part is symmetrical about a plane perpendicular to web 12 of bracket 10 and extending midway between side portions 13 of such bracket.

Stated otherwise, the working end of the moving part has a central web 25 lying generally in the stated plane, and from both sides of which the hub 21 extends. The can-side compression portion 18 and the can-end compression portion 19 are formed by flanges extending outwardly from web 25 except at open regions stated below. Additional flanges, numbered 26 and 27, provide strengthening of the part so as to achieve maximum strength with minimum usage of metal, such additional flanges extending toward handle 17 from the end regions of side compression portion 18 and end compression portion 19. The portions 18 and 19, and the flanges 26 and 27, define the recesses 24 that are bottomed by web 25.

Figure 2:
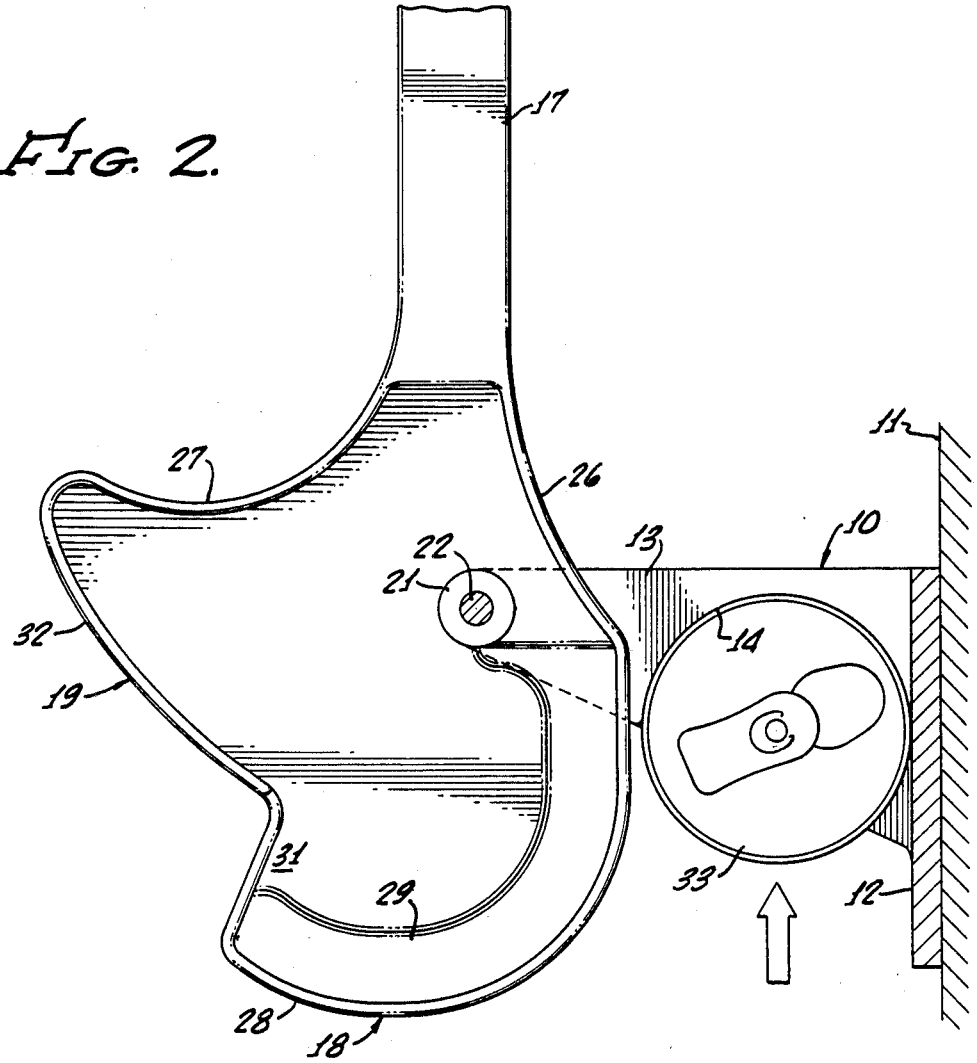
FIG. 2 is a side elevational view of the showing of FIG. 1, but with the can-holding bracket shown in section, and with a can shown in position for compacting.

The can-side compression portion comprises a continuous, elongated, curved cam surface 28 adapted to pass closely adjacent bracket web 12 when the handle 17 is pivoted downwardly from the position shown in FIGS. 1 and 2. There is, however, sufficient clearance provided between surface 28 and the opposed surface of web 12 to permit two layers of aluminum to be disposed therebetween without excessive pressing or rubbing.

Cam surface 28 is shaped to first engage the can side wall tangentially, then to cam itself farther and farther into the can side (toward web 12) and thus flatten a central region of the can against the web. Both can sides are thus flattened against the web, with one can side acting on the other as the cam presses in.

Cam surface 28 is backed by inclined, strengthening and can-centering regions 29 that extend from the vicinity of hub 21 all the way to the lower end of the cam surface 28. Because of the inclined regions 29, the portion of web 25 adjacent cam surface 28 is generally triangular or pyramidal in section, as shown at the lower portion of FIG. 1, and such triangular or pyramidal configuration continues upwardly and to the right in FIG. 1 until the vicinity of hub 21 is reached.

Between the regions 29 at the lower end of cam surface 28, and the lower portion of can-end compression portion 19, are open portions or regions 31 not bounded by flanges and which permit exiting of the bent-over can ends.

Referring next to can-end compression portion 19, this includes (on the above-indicated flanges) a compacting surface 32 that extends generally perpendicularly to the lower end of web 25 as illustrated in FIG. 1. Compacting surface 32, and the underlying flanges which define it, are generally trapezoidal in shape as shown (for example) in FIG. 3, the trapezoid having its base relatively adjacent cam surface 28. Such base is sufficiently wide to engage the bent-over ends of the can after operation of can-side compression portion 18. Likewise, the remainder of compacting surface 32 is sufficiently wide to engage the bent-over ends of the can at a later stage of the compaction process.

As an illustration, stated relative to soft drink cans and beer cans formed of aluminum and of standard eight-ounce sizes, the cam surface 28 is preferably about 1.6 inches wide, whereas the compacting surface is, at its base, preferably about 2.7 inches wide.

METHOD AND OPERATION

The method and operation will now be stated in reference to FIGS. 2–11, which show the entire sequence of operation of the apparatus excepting only the upward movement of handle 17 after can compaction has been completed.

Referring to FIG. 2, the handle 17 is caused to be in upwardly-extending position, and an aluminum can 33 is lifted so as to be seated on the seats 14. Then, handle 17 is pivoted counterclockwise to cause tangential engagement of the upper region of cam surface 28 with the can. Such engagement causes, even if the handle is not gripped by the operator, secure holding of can 33 in seated position on seats 14. Normally, for a right-handed person, the can 33 is positioned by the left hand, following which the right hand is employed to pivot handle 17 downwardly rapidly to effect—in a single operation—compaction of the can. (The left hand no longer being necessary.) The right hand is then employed to shift the handle upwardly to the position of FIGS. 1 and 2, and the can 33 automatically drops into a suitable container.

Figure 4:
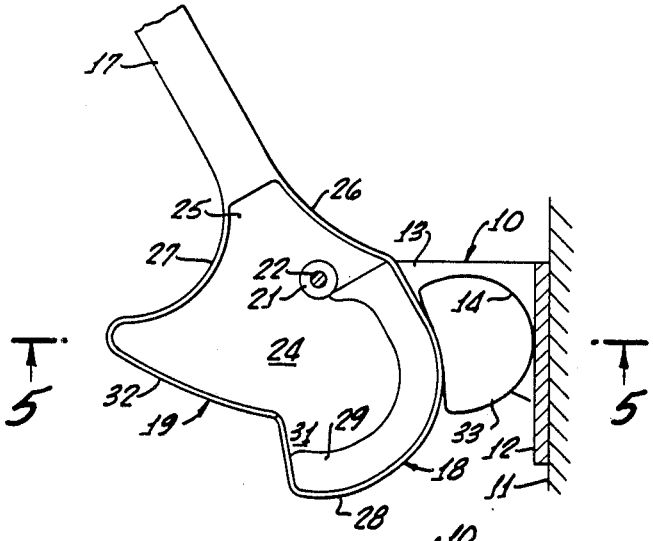
FIG. 4 is a view corresponding to FIG. 2 but showing the condition of the parts during the initial portions of the can-compacting operation.
Figure 5:
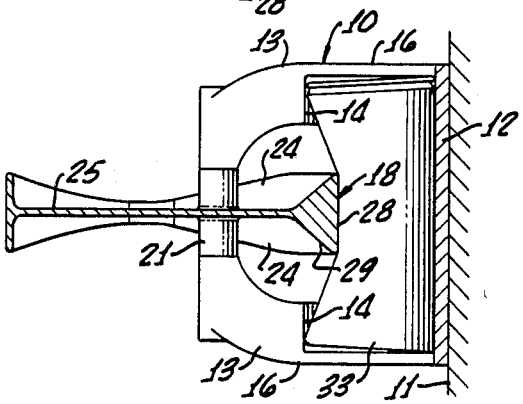
FIG. 5 is sectional view taken on line 5—5 of FIG. 4 and looking upwardly.
Figure 7:
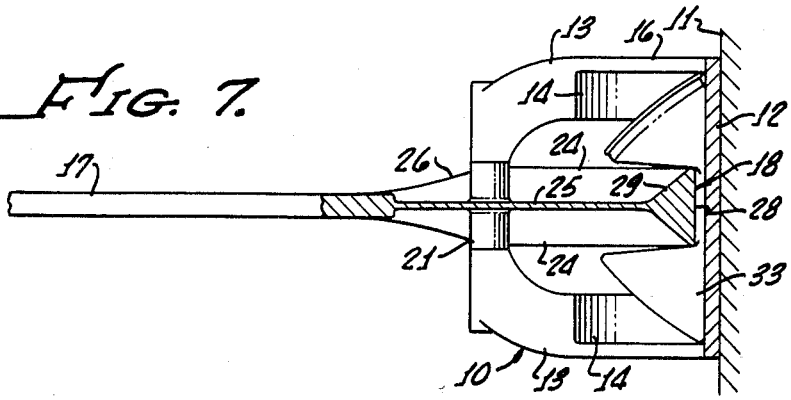
FIG. 7 is a horizontal sectional view on line 7—7 of FIG. 6, illustrating the condition of the can after much of the tucking action has occurred.

Referring next to FIG. 4, there is illustrated a position at which the handle 17 has been shifted down sufficiently far that an upper region of cam surface 28 has cammed into the side of can 33 at the central region thereof to press the engaged sidewall inwardly (see also FIG. 5). Further downward movement of handle 17 causes additional cam action between surface 28 and the sidewall at the center of can 33, to fully compress such center region between cam surface 28 and the inner surface of web 12, as best shown in FIG. 7. Both sides of the can center are thus flattened, as stated above.

Such shifting of the sidewall of can 33 into close adjacency to web 12, at the center of the can, causes the can ends to incline, pivot or bend toward each other, in at least partially "tucked" relationship, as shown in FIG. 7. The relatively adjacent edges of the thus-bent can ends are then in position to be engaged by compacting surface 32.

Figure 8:
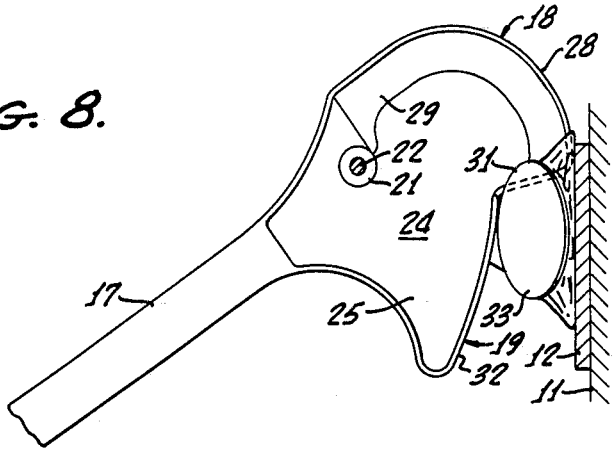
FIG. 8 is another side elevational view and showing the commencement of the end-compression operation by which the ends of the can are moved to complete the tuck.
Figure 9:
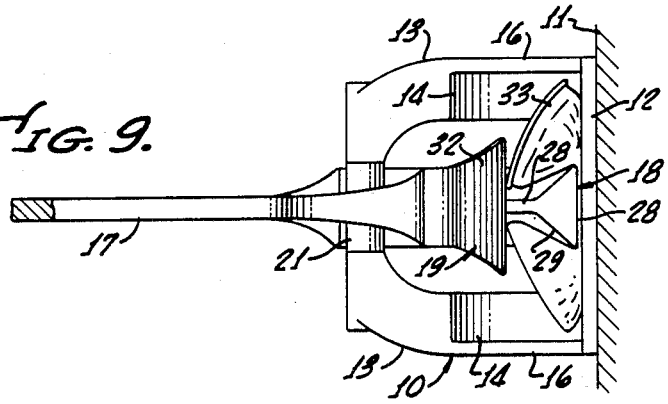
FIG. 9 is a bottom plan view of the showing of FIG. 8.

Referring next to FIGS. 8 and 9, the compacting surface 32 engages the bent ends of can 33 and bends them toward web 12. Such bending causes the can ends to enter recesses 24 adjacent inclined regions 29. The relatively thin web 25 permits the adjacent edges of the can ends to be relatively close to each other even before such adjacent edges exit from the can-side compression portion 18 of the apparatus.

Figure 10:
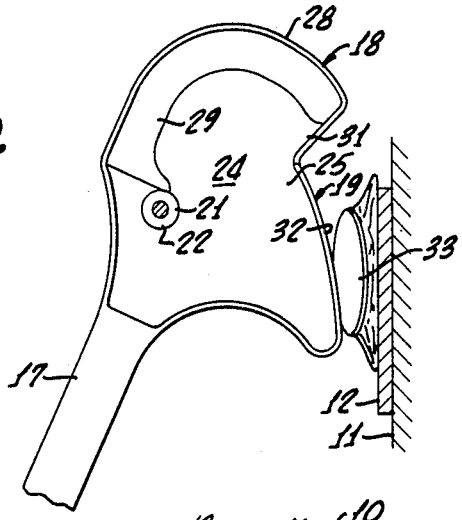
FIG. 10 is an additional side elevational view showing the substantial completion of the can-compaction operation.

Referring to FIG. 1, the open or "exit" regions 31 permit the adjacent edges of the bent-over can ends to emanate from recesses 24 as handle 17 is pivoted downwardly from the position of FIG. 8 to that of FIG. 10. Then, the ends receive their final compaction (additionally bending or inclining) by the compacting surface 32. It is pointed out that the seats 14 hold the can 33 in position even when the can ends are bent over as shown in FIG. 9, so that the can is not shifted upwardly with the can-side compression portion 18 but instead stays in position to be operated upon by compacting surface 32.

Figure 11:
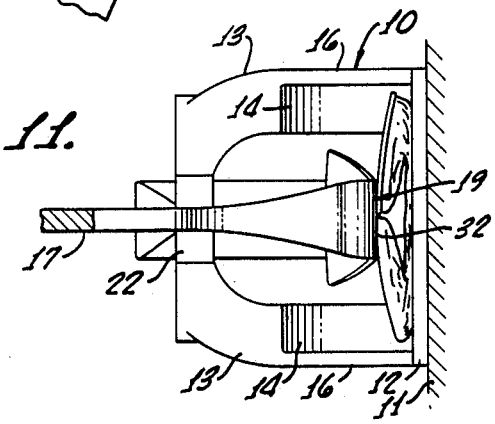
FIG. 11 is a bottom plan view of the showing of FIG. 10.

After additional compaction, as shown in FIGS. 10 and 11, the handle 17 is pivoted upwardly, which permit the compacted can to immediately drop out. The can drops automatically, with no need for operator assistance.

Figure 12:
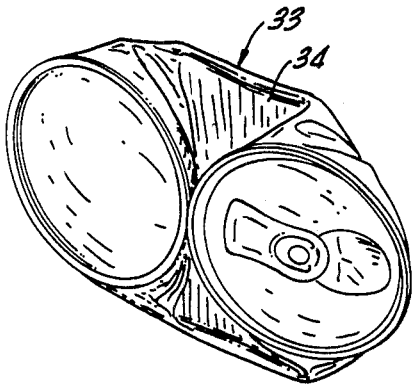
FIG. 12 is an isometric view of the bulls-eye compacted can produced by the present apparatus and method.

There is thus achieved a compacted, bulls-eye aluminum can 33 as shown in FIG. 12, all in a single operation of handle 17 in a single downward direction (except for the upward movement which permits the can to drop out and returns the handle to its initial position for another operation). The downward movement first cams in the side of the can to achieve the flat center region shown at 34 in FIG. 12, following which the can ends are bent or compacted by surface 32 so as to be relatively adjacent the plane of the cammed-in side or region 34.

DETAILED DESCRIPTION OF ADDITIONAL EMBODIMENTS

The following-described embodiment is preferred for compactors wherein the drive is electrical. The embodiment of FIGS. 1–11 is preferred for manually-driven embodiments. It is emphasized that all embodiments of the invention may be driven either manually or electrically.

Referring now to FIGS. 13–16, there is shown a rigid frame 40 adapted to seat or be mounted on a counter top, for example. The frame may be mounted on or disposed adjacent a suitable receptacle for the crushed cans.

The illustrated frame 40 has a horizontal bottom plate 41 that is notched or indented at 42 to provide a space through which the crushed cans may drop. At opposite sides of the notch or indent 42 are upstanding posts 43 and 44. One such post, illustrated as number 44, has incorporated therein a housing-enclosed electric motor and gear means operated by an electrical control circuit, not shown. The gear means may comprise a suitable worm gear, epicyclic gear, etc. As indicated above, operation of the apparatus may also be manual instead of electrical.

A horizontal rod 47 (FIGS. 14 and 15) extends between posts 43 and 44, being fixed in place and nonrotatable. Fixedly, nonrotatably mounted on such rod 47 is the operating element of the previous embodiment. Thus, such element comprises the can-side compression portion 18 and the can-end compression portion 19. In the illustrated form, the element 18–19 is mounted such that the can-side compression portion is generally above the can-end compression portion. With such an orientation, the crushed cans will drop off the can-end compression portion by gravity, as described subsequently.

A combination can-actuating and can-feeding means 49 is mounted on fixed rod 47 by crank and bearing means 50, the relationship being such that the means 49 may rotate continuously in the same direction about the rod 47. The combination can-actuating and can-feeding means has a back-up wall 51 against which the can is crushed, also has end walls 52 to prevent undesired axial shifting of the can, and also has generally arcuate seats disposed adjacent end walls 52 to seat the end portions of the can. Such seats are curved correspondingly to the can, the can being indicated in phantom at 54.

As shown in FIGS. 13, 14, and 16, the combination means 49 also includes feeding openings 56 extended through the seats 53 relatively adjacent back-up wall 51. The opening 56 not shown in FIG. 14, namely, the opening through the seat 53 that is nearest post 44, is the mirror image of the illustrated opening 56. Such openings assure that there will be no jamming of the apparatus; that is to say, the combination can-actuating and can-feeding means 49 is able to rotate past the can-end compression portion 19 without being jammed by the can. Instead, the can drops by gravity through indent 42.

In the present embodiment, the radial dimensions are caused to be such that the back-up wall 51 can rotate past all portions of the can-side compression portion 18 and can-end compression portion 19 without locking therewith, there being sufficient clearance therebetween to receive a double layer of can metal. Reference is made to FIG. 15, where the back-up wall 51 is shown in two positions, one adjacent but spaced somewhat from portion 18 and the other adjacent but spaced somewhat from portion 19.

The control circuit (not shown) for the electric motor (not shown) within post 44 is such that the motor stops when the combination means 49 is in the position shown in FIGS. 13 and 14. Then, when the motor is started as by pressing a button, the element 49 is electrically driven counterclockwise for one revolution until it returns to the position shown in FIGS. 13 and 14.

In performing the method with the apparatus of FIGS. 13–16, an aluminum beverage can 54 is first deposited in the combination can-actuating and can-feeding means 49 as shown in FIGS. 13 and 14. The start button is then pushed, causing the element 49 to rotate counterclockwise to the position extending generally horizontally and to the left as shown in phanton line in FIG. 15. During the first part of such counterclockwise movement, it is assured that the can cannot escape from its seat, because there is an outer housing provided primarily for decorative and protective purposes. One wall of such housing, shown fragmentarily at H in FIG. 14, prevents the can from moving by gravity or being jarred out of the seat since such wall is spaced somewhat more than a can diameter from, and generally parallel to, the upper region of the cam surface of element 18.

Figure 6:
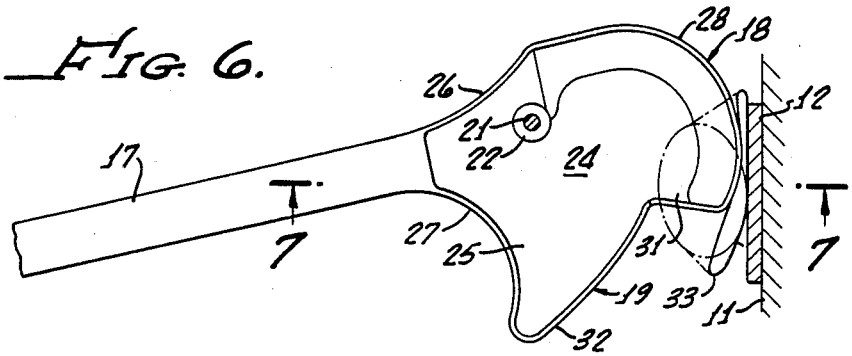
FIG. 6 is a view corresponding to FIGS. 2 and 4 but showing the final portion of cam operation.

During movement of the can from the FIG. 14 position to the one shown at the left in FIG. 15, the can is tucked substantially correspondingly to what is shown in FIGS. 6 and 7.

Continued counterclockwise rotation of element 49 shifts the tucked can away from can-side compression portion 18, whereupon the right edges (in the orientation of FIG. 15) of the can ends engage the can-end compression portion 19. Further counterclockwise movement of element 49 causes the can ends to be collapsed or compressed between portion 19 and wall 51 until a substantial amount of collapsing has occurred. When the collapsing is sufficiently great, so that the can ends are bent sufficiently to pass through the feeding openings 56 (particular reference being made to FIG. 16), the element 49 and its back-up wall 51 move past the bottom end of compression portion 19 and, at the same time, the can drops into or through notch or indent 42. Stated in another manner, the element 49 feeds the can sufficiently far relative to portion 19 that the can ends will be collapsed to a desired extent, following which feeding of the can ceases. Instead, the can remains stationary while the walls of feed openings 56 pass by it during continued counterclockwise movement of the means 49. When the element 49 has passed substantially completely past the can, the can drops into or through the notch or indent 42. The element 49 then continues counterclockwise, back to the loading position shown in FIGS. 13 and 14.

It is pointed out that by collapsing first the sidewall and then the ends of the can, instead of collapsing them simultaneously, there is much more uniformity of can crushing, and, furthermore, the power or strength requirements of the apparatus are vastly reduced.

The foregoing detailed description is to be clearly understood as given by way of illustration and example only, the spirit and scope of this invention being limited solely by the appended claims.

What is claimed is:

1. A can compactor for beverage cans formed of aluminum, which comprises:

(a) cam means to collapse the side of a can, and to cause the ends of the can to incline towards each other, (b) means to effect further inclination of said can ends after cessation of operation at said cam means, and (c) means to effect operation of first said means (a) and then means (b), said means (a), (b) and (c) being all provided as a single element each part of which is fixed relative to the other.

2. Apparatus for compacting an aluminum beverage can into bulls-eye configuration, comprising:

(a) support means having a surface against which the central-side region of a can is adapted to be substantially flattened, (b) first and second seat means to seat the ends of a can in such position that one side thereof is adjacent said support means, said seat means being spaced apart to permit movement of cam means therebetween, (c) cam means, (d) means to pivotally mount said cam means for pivotal movement about an axis generally parallel to said can when said can is seated in said seat means, said cam means being disposed between said seat means, said cam means being so shaped that pivotal movement thereof about said axis will cause said cam means to engage a side of said can remote from said support means, and is also so shaped that further pivotal movement of said cam means will progressively flatten both sides of the can against said support means at a region between the ends of said can, said flattening causing the ends of the can to incline towards each other, and (e) means to pivot said cam means about said pivotal mounting means to effect said flattening and inclining.

3. The invention as claimed in claim 2, in which said means (e) is a manually operated crank connected to said cam means.

4. The invention as claimed in claim 3, in which end-compactor means are fixedly connected to said cam means for pivoting by said crank, and are so positioned relative to said cam means that said inclined can ends are engaged and further inclined by said cam means after said cam means has effected said flattening.

5. The invention as claimed in claim 2, in which said cam means comprises means to define a curved cam surface having a substantial dimension in a direction parallel to said can, and in which a thin cam support portion is connected to said cam surface-defining means centrally thereof, to thus permit the can ends to tuck around said cam surface defining means.

6. The invention as claimed in claim 5, in which means are connected to said thin cam support portion to engage simultaneously, and further incline, both ends of said can after said ends have been initially inclined by said cam means.

7. The invention as claimed in claim 6, in which said can end-engaging and further-inclining means is located near the end of said cam surface that last operates on the side of said can, and is spaced away from said end of said cam surface, the space between said ends-engaging means and the end of said cam surface being open to permit stripping of said can of said cam surface-defining means by said seat means.

8. The invention as claimed in claim 6, in which said cam-surface defining means has inclined wall means on the side thereof opposite said cam surface.

9. Apparatus for compacting an aluminum beverage can, which comprises:

(a) cam means, and (b) means to effect movement of said cam means and an aluminum beverage can relative to each other to progressively engage said cam means and only side portions of said can and thus collapse said side portions of said can, said means (b) being such that said relative movement is in a single direction during said collapsing of said can side portions, said cam means (a) and said means (b) being such that said relative movement in said single direction continues until said cam means is no longer engaged with said can.

10. The invention as claimed in claim 9, in which end-bending means additional to said cam means are provided to bend in the ends of said can and thus cause said can to be further compacted.

11. The invention as claimed in claim 10, in which said cam means and said end-bending means are, at all times during can compaction, substantially fixed in position relative to each other.

12. The invention as claimed in claim 9, in which said single direction of relative movement is generally tangential to said can.

13. The invention as claimed in claim 9, in which said cam means is a single cam means that progressively engages one side of said can and thus substantially flattens both sides of said can against a back-up means.

14. The invention as claimed in claim 13, in which the distance between said cam means and back-up means is always greater than two can-wall thicknesses, so that said can is not pinched between said cam means and back-up means.

* * * * *